US009851683B2

(12) United States Patent
Imaizumi

(10) Patent No.: US 9,851,683 B2
(45) Date of Patent: Dec. 26, 2017

(54) STORAGE CONTAINER AND IMAGE FORMING APPARATUS

(71) Applicant: CANON KABUSHIKI KAISHA, Tokyo (JP)

(72) Inventor: Chikara Imaizumi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/166,318

(22) Filed: May 27, 2016

(65) Prior Publication Data

US 2016/0349667 A1 Dec. 1, 2016

(30) Foreign Application Priority Data

May 29, 2015 (JP) ..... 2015-110472

(51) Int. Cl.
*G03G 21/16* (2006.01)

(52) U.S. Cl.
CPC . *G03G 21/1633* (2013.01); *G03G 2215/0132* (2013.01); *G03G 2221/1684* (2013.01)

(58) Field of Classification Search
CPC .. G03G 15/0886; G03G 21/12; G03G 21/105; G03G 21/1633
USPC ..... 399/358, 360
See application file for complete search history.

(56) References Cited

U.S. PATENT DOCUMENTS

| | | | |
|---|---|---|---|
| 7,486,907 | B2 | 2/2009 | Noguchi et al. |
| 7,567,769 | B2 | 7/2009 | Noguchi et al. |
| 7,660,549 | B2 | 2/2010 | Noguchi et al. |
| 7,715,752 | B2 | 5/2010 | Sakurai et al. |
| 7,761,024 | B2 | 7/2010 | Imaizumi et al. |
| 7,856,192 | B2 | 12/2010 | Koishi et al. |
| 7,890,012 | B2 | 2/2011 | Koishi et al. |
| 7,907,866 | B2 | 3/2011 | Imaizumi et al. |
| 7,937,020 | B2 | 5/2011 | Sakurai et al. |
| 8,139,979 | B2 | 3/2012 | Koishi et al. |
| 8,145,095 | B2 | 3/2012 | Sakurai et al. |
| 8,175,487 | B2 | 5/2012 | Imaizumi et al. |
| 8,442,412 | B2 | 5/2013 | Imaizumi et al. |
| 8,463,157 | B2 | 6/2013 | Sakurai et al. |
| 8,526,841 | B2 | 9/2013 | Koishi et al. |
| 8,843,023 | B2 | 9/2014 | Fujinaka et al. |
| 8,862,014 | B2 | 10/2014 | Imaizumi et al. |

(Continued)

FOREIGN PATENT DOCUMENTS

| | | | |
|---|---|---|---|
| JP | H04-166977 | A | 6/1992 |
| JP | 2002-169440 | A | 6/2002 |
| JP | 2010-160512 | A | 7/2010 |

*Primary Examiner* — Sandra Brase
(74) *Attorney, Agent, or Firm* — Fitzpatrick, Cella, Harper & Scinto

(57) ABSTRACT

To provide a technique to reduce force required for opening or closing a cover disposed in an image forming apparatus, the present invention provides a storage container that is attached to an open-close door in a state where the open-close door is open to expose inside of the image forming apparatus, and that is disposed in a predetermined attaching position in the image forming apparatus by closing of the open-close door. The storage container has an inlet for toner to enter, and a storage portion to store the toner. The inlet is opened in synchronization with operation of attaching the storage container to the open-close door, and the inlet is closed in synchronization with operation of detaching the storage container from the open-close door.

20 Claims, 15 Drawing Sheets

(56) References Cited

U.S. PATENT DOCUMENTS

| | | | | |
|---|---|---|---|---|
| 8,862,015 | B2 | 10/2014 | Koishi et al. | |
| 9,002,230 | B2 | 4/2015 | Imaizumi et al. | |
| 2003/0219292 | A1* | 11/2003 | Serizawa | G03G 21/12 399/360 |
| 2005/0036810 | A1* | 2/2005 | Murakami | G03G 21/12 399/360 |
| 2005/0260019 | A1* | 11/2005 | Arai | G03G 21/12 399/360 |
| 2011/0103856 | A1* | 5/2011 | Sato | G03G 21/12 399/360 |

* cited by examiner (RIGHT SIDE VIEW)

(FRONT VIEW)

(LEFT SIDE VIEW)

(RIGHT SIDE VIEW)

(FRONT VIEW)

(LEFT SIDE VIEW)

(FRONT VIEW)

(FRONT VIEW)

(LEFT SIDE VIEW)

(RIGHT SIDE VIEW)

(FRONT VIEW)

(LEFT SIDE VIEW)

STORAGE CONTAINER AND IMAGE FORMING APPARATUS

BACKGROUND OF THE INVENTION

Field of the Invention

The present invention relates to a storage container for storing toner and an image forming apparatus using electrophotography.

Description of the Related Art

In a conventional electrophotographic image forming apparatus, such as a printer and facsimile, at times toner remains on a photosensitive drum, intermediate transfer belt or the like, because a toner image formed on the photosensitive drum, intermediate transfer belt or the like is not completely transferred to a recording medium, such as paper. The residual toner remaining on the photosensitive drum, intermediate transfer belt or the like is removed therefrom by cleaning means, and is transported to a toner storage container disposed inside the apparatus main unit by toner transport means.

When the toner storage container becomes full with residual toner, the user replaces the toner storage container with an empty toner storage container. Here the residual toner removed by the cleaning means may enter the toner storage container from an outlet disposed on the toner transport means through an inlet disposed on the toner storage container. Conventionally the user manually attaches a cover to the opening when the toner storage container is removed from the apparatus main unit, so that the residual toner does not leak from the toner storage container.

According to an invention disclosed in Japanese Patent Application Laid-Open No. 2002-169440, a toner storage container can be attached to a cover disposed on an image forming apparatus, and an outlet disposed on toner transport means can be connected to an inlet disposed on the toner storage container in synchronization with operation of closing the cover. Thereby the residual toner can be transported into the toner storage container through the outlet. Furthermore, according to the invention disclosed in Japanese Patent Application Laid-Open No. 2002-169440, a shutter is disposed on the outlet and the inlet respectively. The shutters are closed when the cover is open, and the respective shutters are opened in synchronization with operation of closing the cover. Thereby toner leakage from the toner storage container can be prevented when the user replaces the toner storage container.

However, in the case of the invention disclosed in Japanese Patent Application Laid-Open No. 2002-169440, a plurality of inlets are disposed on the toner storage container, and a corresponding number of outlets are disposed on the toner transport means. Since a plurality of inlets and a plurality of outlets are disposed, force to open the shutters disposed on the inlets and outlets increases accordingly. In other words, a strong force is required for the user to open the cover, which makes the cover difficult to open or close.

Further, if the reaction force received by the cover is strong when the cover is opened or closed, and if the cover is not sufficiently rigid, then the cover may be significantly deformed and may not completely close. This may cause the user to feel unsure when the cover is closed.

SUMMARY OF THE INVENTION

With the foregoing in view, it is an object of the present invention to provide a technique to decrease the force that is required to open or close the cover disposed on the image forming apparatus.

An object of present invention is to provide a storage container that can be attached to or detached from an image forming apparatus including an apparatus main unit and an open-close member that can open or close with respect to the apparatus main unit, the storage container comprising:

a storage portion configured to store toner;

an opening portion configured to move the toner between the storage portion and the image forming apparatus main unit; and a shutter configured to open or close the opening portion, wherein the storage container can be attached to the open-close member in an opened state with respect to the apparatus main unit, and the shutter opens the opening portion in synchronization with operation of attaching the storage container to the open-close member, and closes the opening portion in synchronization with operation of detaching the storage container from the open-close member.

Another object of present invention is to provide an image forming apparatus, comprising:

the storage container; and an open-close door which the storage container is attached to or detached from, wherein a timing when the storage container is attached to or detached from the open-close door and a timing when the open-close door is opened or closed are different.

Another object of present invention is to provide a storage container that can be attached to or detached from an image forming apparatus including an apparatus main unit and an open-close member that can open or close with respect to the apparatus main unit, the storage container comprising:

a storage portion that has a first opening portion and a second opening portion for toner to enter, and stores the toner;

a first shutter that is disposed in the storage portion and opens the first opening portion in synchronization with operation of attaching the storage container to the open-close member; and a second shutter that is disposed in the storage portion, opens the second opening portion in synchronization with operation of closing the open-close member when the open-close member is closed after the first opening portion is opened by the first shutter, and closes the second opening portion in synchronization with the operation of opening the open-close member.

Further features of the present invention will become apparent from the following description of exemplary embodiments with reference to the attached drawings.

DESCRIPTION OF THE EMBODIMENTS

Embodiments of the present invention will be described below with reference to the drawings. Dimensions, materials, shapes and relative positions and the like of the components to be described in the embodiments should be changed appropriately depending on the configurations and the various conditions of the apparatus to which the invention is applied, and are not intended to limit the scope of the invention to the following embodiments.

Example 1

<Configuration of Image Forming Apparatus>

Figure 1:
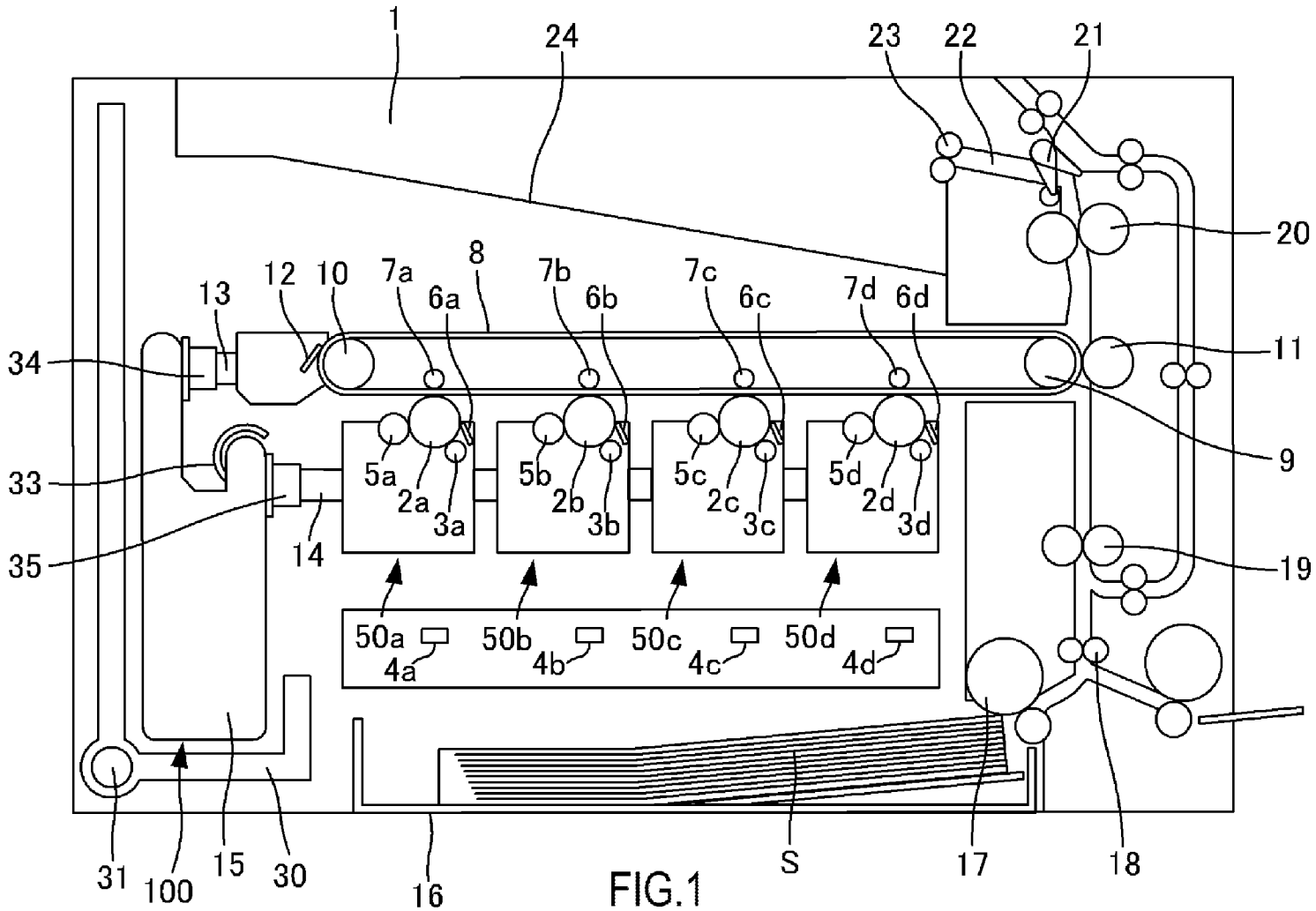
FIG. 1 is a schematic cross-sectional view of an image forming apparatus according to Example 1.

Example 1 will be described. FIG. 1 is a schematic cross-sectional view of an image forming apparatus 1 according to Example 1. The image forming apparatus 1 has a photosensitive drum 2 (2*a*, 2*b*, 2*c*, 2*d*), a charging device 3 (3*a*, 3*b*, 3*c*, 3*d*), a scanner unit 4 (4*a*, 4*b*, 4*c*, 4*d*) and a developing assembly 5 (5*a*, 5*b*, 5*c*, 5*d*). The image forming apparatus 1 also has a drum cleaning device 6 (6*a*, 6*b*, 6*c*, 6*d*). In this example, the photosensitive drum 2, the charging device 3, the scanner unit 4, the developing assembly 5 and the drum cleaning device 6 are integrated as a process cartridge 50 (50*a*, 50*b*, 50*c*, 50*d*). The configuration of each process cartridge 50 is the same except for the toner color, therefore additional indicators (a, b, c, d) are omitted unless specification is necessary.

The four photosensitive drums 2 are disposed side-by-side roughly in a horizontal direction in the image forming apparatus 1 (in the image forming apparatus). Each photosensitive drum 2 is rotation-driven clockwise in FIG. 1 by driving means (not illustrated). The charging device 3 uniformly changes the surface of the photosensitive drum 2. The scanner unit 4 forms a latent image on each photosensitive drum 2 by irradiating a laser beam onto the photosensitive drum 2 based on image information. The developing assembly 5 develops the latent image by allowing toner (toner) to attach to the latent image. The drum cleaning device 6 removes residual toner remaining on the photosensitive drum 2 after the toner image on the photosensitive drum 2 is transferred to an intermediate transfer belt 8.

In this example, four process cartridges 50 form different color (yellow, cyan, magenta, black) toner images by an electrophotographic recording system. Each primary transfer roller 7 (7*a*, 7*b*, 7*c*, 7*d*) functions as transfer means, and contacts the photosensitive drum 2 via the intermediate transfer belt 8, so as to transfer the toner image on the photosensitive drum 2 to the intermediate transfer belt 8.

The intermediate transfer belt 8 is stretched between a driver roller 9 and a tension roller 10, and moves counterclockwise in FIG. 1 by driving the driver roller 9. A secondary transfer roller 11, which is disposed at a position facing the driver roller 9 via the intermediate transfer belt 8, transfers the toner image transferred to the intermediate transfer belt 8 to a sheet S. A cleaning blade 12, for removing the residual toner on the intermediate transfer belt 8, and belt-side toner transport means 13, are disposed at a position facing the tension roller 10 via the intermediate transfer belt 8. The residual toner, which is waste toner, on the intermediate transfer belt 8 is collected by the cleaning blade 12, and the collected residual toner is transported into the toner storage portion 15 (into the storage portion) by the belt-side toner transport means 13.

Sheets S (recording media) are loaded into a paper feeding cassette 16, which is disposed at the bottom of the image forming apparatus 1. A paper feeding roller 17 feeds the sheets S, which are loaded into the paper feeding cassette 16, one sheet at a time. A paper drawing roller 18 transports each sheet S, fed by the paper feeding roller 17, to a resist roller pair 19, and the resist roller pair 19 corrects the oblique positioning of the sheet S. Fixing means 20 heats and presses a toner image formed on the sheet S, so as to fix the toner image onto the sheet S. A double-sided flapper 21 can switch a path to which the sheet S is transported, and guides the sheet S to a discharge transport path 22 in the case of single-sided printing. A paper ejection roller pair 23 discharges the sheet S, on which the image is formed, to a paper ejection tray 24.

Now an operation performed by the image forming apparatus 1 when an image is formed on a sheet S will be described. The sheets S loaded into the paper feeding cassette 16 are separated one-by-one by the paper feeding roller 17, and are transported to the paper drawing roller 18. Each sheet S transported to the paper drawing roller 18 is transported to the resist roller pair 19, and is transported to a nip portion of the intermediate transfer belt 8 and the secondary transfer roller 11 by the resist roller pair 19.

At this nip portion, the toner image is transferred from the intermediate transfer belt 8 to the sheet S, and the sheet S, on which the toner image is transferred, is then transported to the fixing means 20. The toner image formed on the sheet S is fixed to the sheet S by the fixing means 20. The sheet S, on which the image is formed, is guided by the double-sided flapper 21 to the discharge transport path 22, and is discharged to the paper ejection tray 24 by the paper ejection roller pair 23.

<How to Collect Residual Toner into Toner Storage Container>

Figure 2:
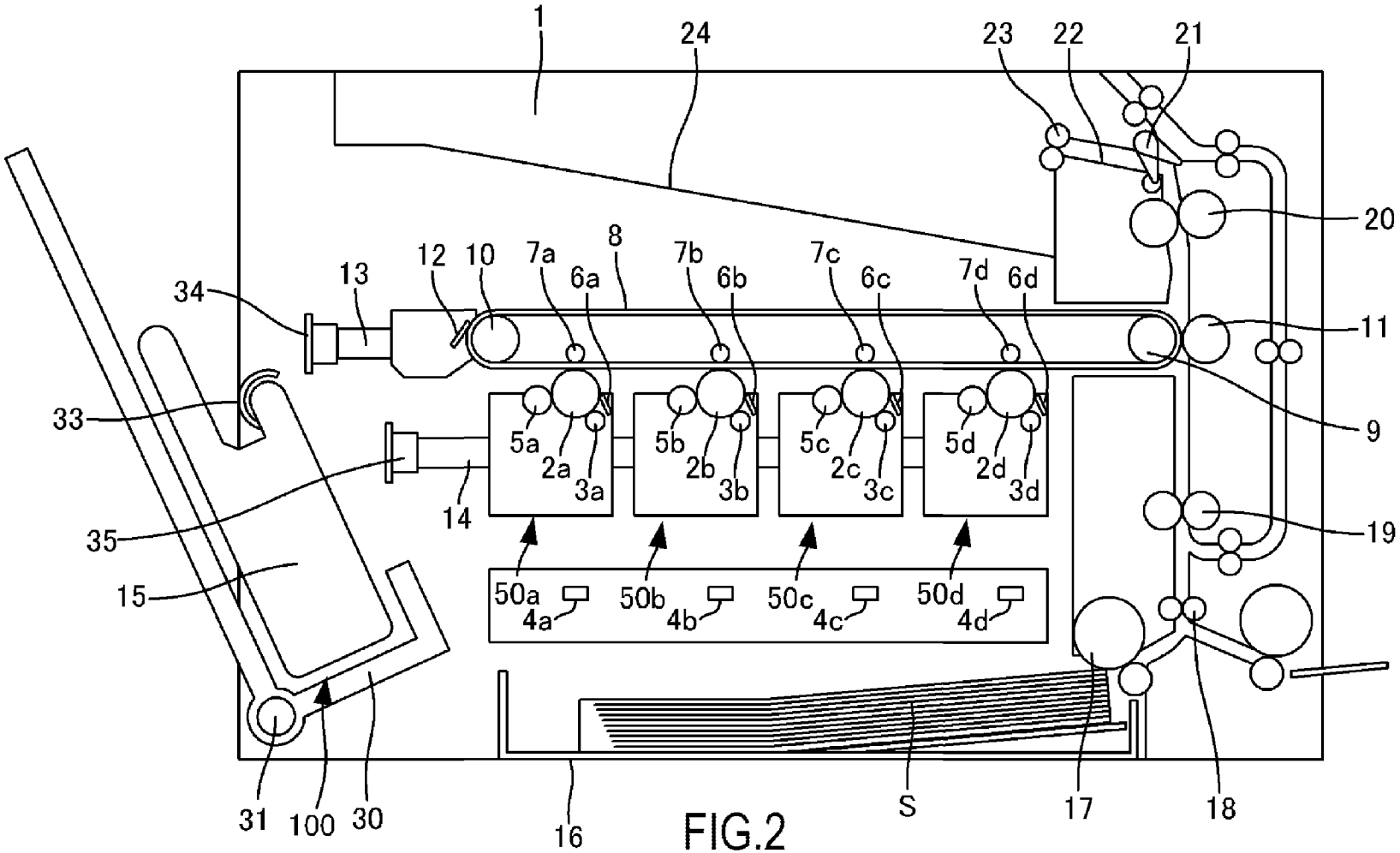
FIG. 2 is a schematic cross-sectional view of the image forming apparatus in a state where an open-close door is open.
Figure 3:
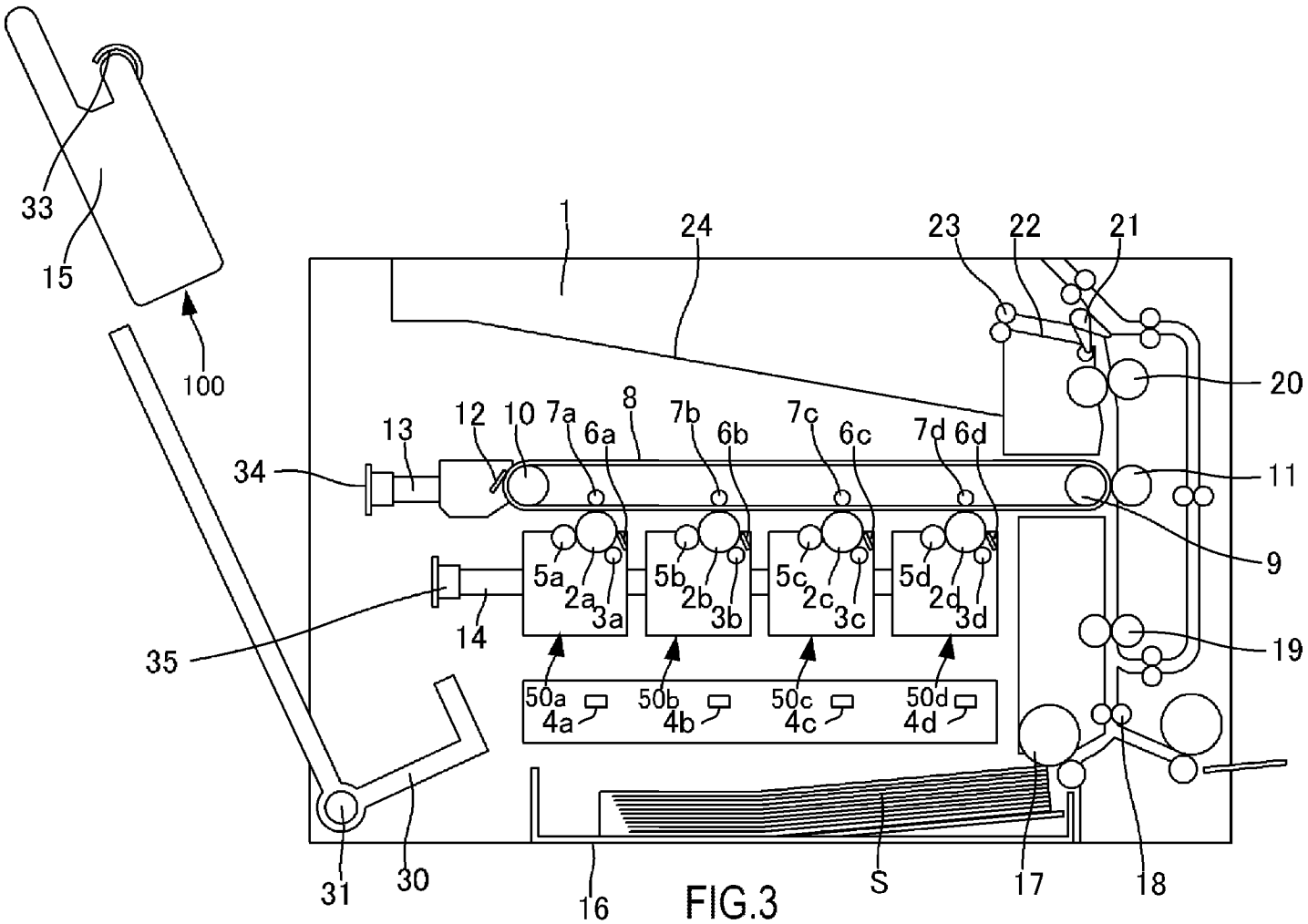
FIG. 3 is a schematic cross-sectional view of the image forming apparatus in a state where a storage container is detached.

A method of collecting residual toner, which remains on the photosensitive drum 2 and the intermediate transfer belt 8, into the toner storage portion 15 will be described next with reference to FIGS. 1 to 5B. FIG. 2 shows the image forming apparatus 1 in a state where a left door 30 (open-close door), to which the storage container 100 is attached, is open. FIG. 3 shows a state where the storage container 100 is detached from the left door 30 disposed on the image forming apparatus 1.

Figure 4A:
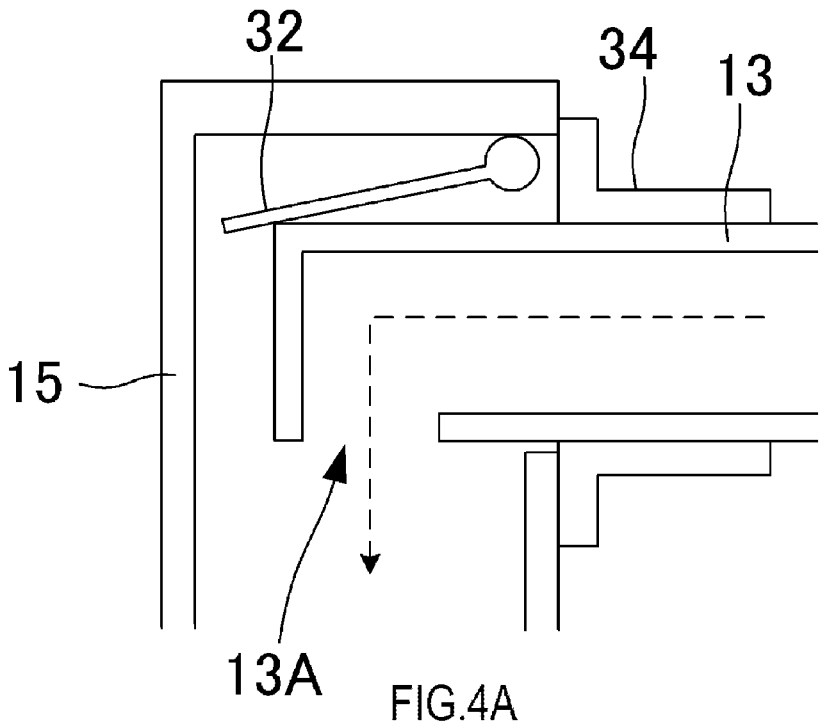
FIGS. 4A and 4B are enlarged views depicting a state where an inlet on the storage container and toner transport means are connected.
Figure 4B:
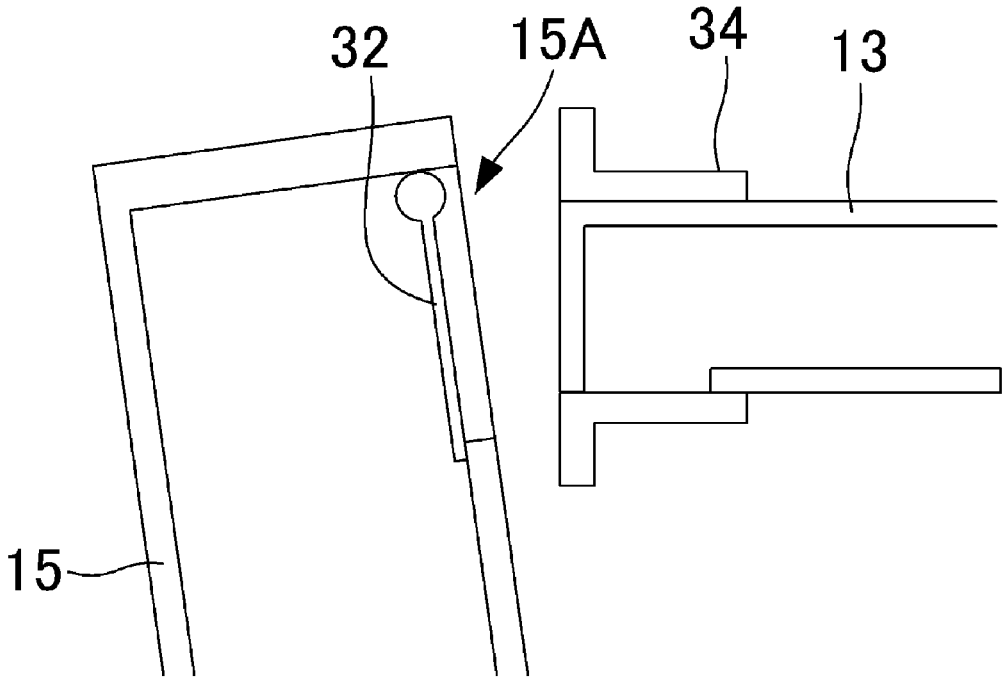
Figure 5A:
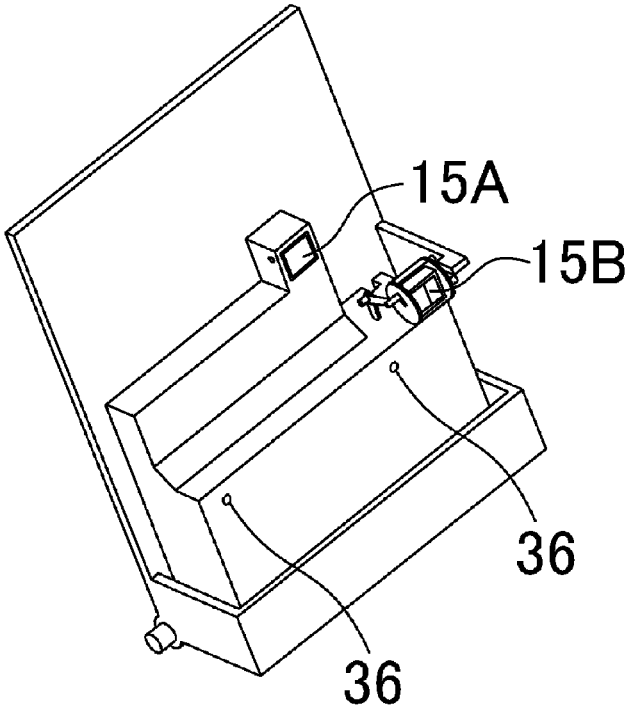
FIGS. 5A and 5B are diagrams depicting a state where the storage container is attached to or detected from the open-close door.
Figure 5B:
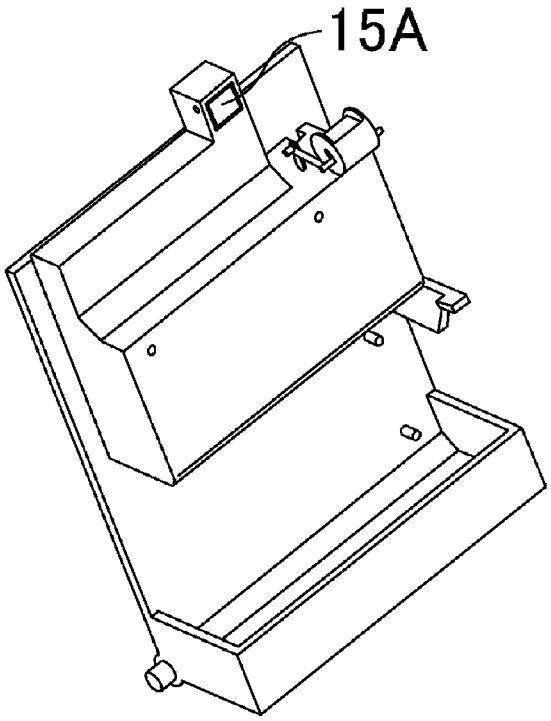

FIGS. 4A and 4B are enlarged views of the portion where the inlet 15A disposed on the toner storage portion 15 and the outlet 13A disposed on the belt-side toner transport means 13 are connected. FIG. 4A shows a state where the inlet 15A and the outlet 13A are connected. FIG. 4B shows a state where the inlet 15A and the outlet 13A are not connected. FIGS. 5A and 5B are diagrams depicting the state where the storage container 100 is attached to or detached from the left door 30. FIG. 5A shows a state where the storage container 100 is attached to the left door 30. FIG. 5B shows a state where the storage container 100 is detached from the left door 30. In FIG. 1, the left door 30 is an openable or closable cover where the detachable storage container 100 can be attached. The left door 30 rotates around the rotation axis 31, and when the left door 30 is open, the inside of the image forming apparatus 1 is exposed. The detachable storage container 100 can be attached to the left door 30, and when the left door 30 is open, the storage container 100 in the image forming apparatus 1 is exposed. Here the storage container 100 includes a toner storage portion 15 and a shutter 33.

The belt-side transport toner means 13 transports the residual toner, which was removed from the intermediate transfer belt 8 by the cleaning blade 12, to the toner storage portion 15. The residual toner on the intermediate transfer belt 8 is removed by the cleaning blade 12, and the removed residual toner is transported into the toner storage portion 15 by a toner transport screw (not illustrated). The inlet 15A (see FIGS. 4A and 4B), into which the residual toner removed from the intermediate transfer belt 8 is transported, is disposed on the toner storage portion 15, and an outlet 13A (see FIGS. 4A and 4B), through which the residual toner is discharged, is disposed on the belt-side toner transport means 13. When the left door 30 is closed in a state where the storage container 100 is attached to the left door 30, the inlet 15A and the outlet 13A are connected, whereby the belt-side toner transport means 13 feeds the residual toner into the toner storage portion 15 through the inlet 15A. Further, by closing the left door 30 in the state where the storage container 100 is attached to the left door 30, the storage container 100 is attached to a predetermined attaching position inside the image forming apparatus 1.

The drum-side toner transport means 14 transports the residual toner, which was removed from the photosensitive drum 2 by the drum cleaning device 6, into the toner storage portion 15. The residual toner on the photosensitive drum 2 is removed by the drum cleaning device 6, and the removed residual toner is transported into the toner storage portion 15 by the toner transport screw (not illustrated). An inlet 15B (see FIGS. 6A to 6C), into which the residual toner removed from the photosensitive drum 2 is transported, is disposed on the toner storage portion 15, and an outlet (not illustrated), through which the residual toner is discharged, is disposed on the drum-side toner transport means 14. When the left door 30 is closed in a state where the storage container 100 is attached to the left door 30, the inlet 15B and the outlet (not illustrated) are connected, whereby the drum-side toner transport means 14 transports the residual toner into the toner storage portion 15 through the inlet 15B.

A shutter 34 for opening or closing the outlet 13A is disposed on the belt-side toner transport means 13, and a shutter 32 for opening or closing the inlet 15A is disposed on the toner storage portion 15. When the left door 30 is closed, the shutter 32 and the shutter 34 open in synchronization with operation of closing the left door 30, whereby the inlet 15A and the outlet 13A are connected. Further, a shutter 35 for opening or closing the outlet (not illustrated) is disposed on the drum-side toner transport means 14, and a shutter 33 for opening or closing the inlet 15B (see FIGS. 6A to 6C) is disposed on the toner storage portion 15.

The shutter 33 closes the inlet 15B in synchronization with operation of detaching the storage container 100 from the left door 30 (close state), and opens the inlet 15B in synchronization with operation of detaching the storage container 100 from the left door 30 (open state). In other words, according to this example, the timing when the shutter 33 opens or closes the inlet 15B in synchronization with operation of attaching or detaching the storage container 100 with respect to the left door 30, and the timing when the shutter 32 opens or closes the inlet 15A in synchronization with operation of opening or closing the left door 30, are different. The mechanism of opening or closing of the shutter 33 will be described in detail later. In a state where the storage container 100 is attached to the left door 30, the inlet 15B is open, and the inlet 15B and the outlet (not illustrated) are connected in synchronization with operation of closing the left door 30.

<How to Replace Toner Storage Container>

A method for replacing the storage container 100 will be described next. When a toner amount detection sensor (not illustrated) detects that the toner storage portion 15 is full with residual toner, an indication to prompt the replacement of the storage container 100 is displayed on a display portion (not illustrated). If the replacement of the storage container 100 is prompted, the user opens the left door 30 as shown in FIG. 2 by turning the left door 30 counterclockwise (as viewed in FIG. 3) around the rotation axis 31. At this time, the shutter 34 slides to the left with respect to the belt-side toner transport means 13, against the biasing force of the spring (not illustrated), as shown in FIGS. 4A and 4B, so as to close the outlet 13A on the belt-side toner transport means.

The shutter 35 for opening or closing the outlet (not illustrated) of the drum-side toner transport means 14 also slides to the left against the biasing force of the spring (not illustrated), just like the shutter 34, so as to close the outlet (not illustrated) on the drum-side toner transport means. Then as shown in FIG. 3, the storage container 100 is slid in the upper left direction, whereby the storage container 100 is detached from the left door 30, and is removed from the image forming apparatus 1. In this step, the shutter 33 closes the inlet 15B on the toner storage portion 15. Thereby, in the state where the toner storage portion 15 is removed from the image forming apparatus 1, the inlet 15A and the inlet 15B on the toner storage portion 15 are closed.

Then an empty storage container 100 is attached to the left door 30 after the storage container 100, filled with the residual toner, is removed. The empty storage container 100 is attached to the left door by sliding the storage container 100 to the lower left direction. When the empty storage container 100 is in the unused state, the shutter 33 closes the inlet 15B, but in this step, the shutter 33 opens the inlet 15B. Then the shutter 34 opens the inlet 15A in synchronization with operation of closing the left door 30, as shown in FIGS. 4A and 4B.

Just like shutter 34, the shutter 35 also opens the outlet (not illustrated) on the drum-side toner transport means 14. Ata timing when the left door 30 closes completely, a positioning boss 36 disposed on the toner storage portion 15 engages with a positioning hole (not illustrated) disposed on the main body of the image forming apparatus 1. Thereby the storage container 100 is positioned with respect to the apparatus main unit of the image forming apparatus 1. By the above operation, the operation of replacing the storage container 100 completes.

<Mechanism of Closing Shutter>

Figure 6C:
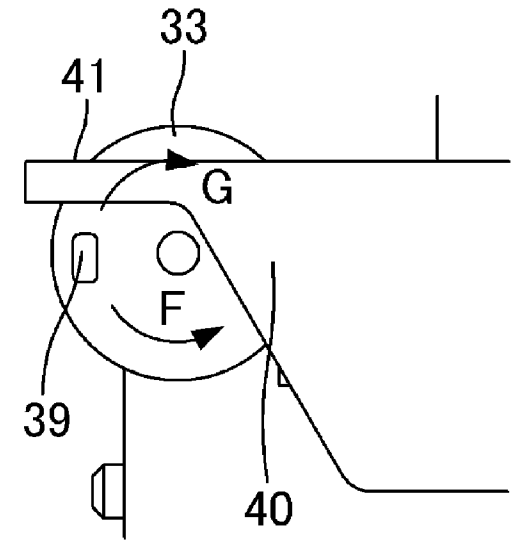
FIGS. 6A to 6C are diagrams depicting an open-close mechanism in a state where attaching of the storage container begins.
Figure 6B:
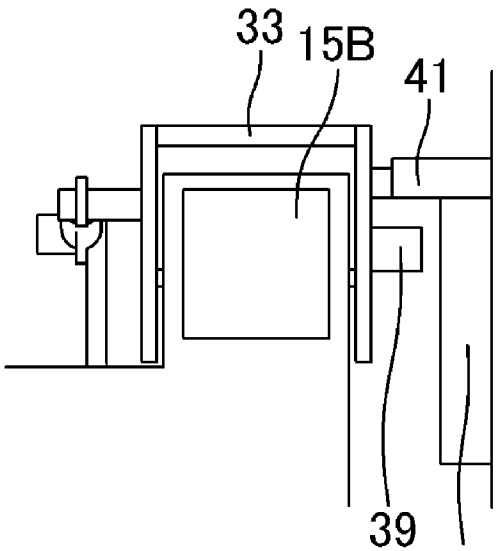
Figure 6A:
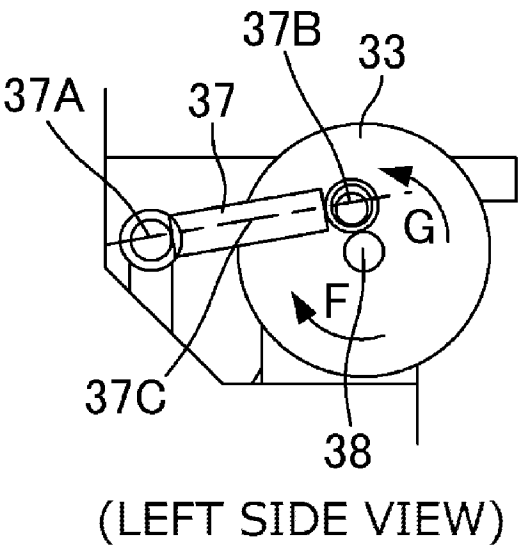
Figure 7C:
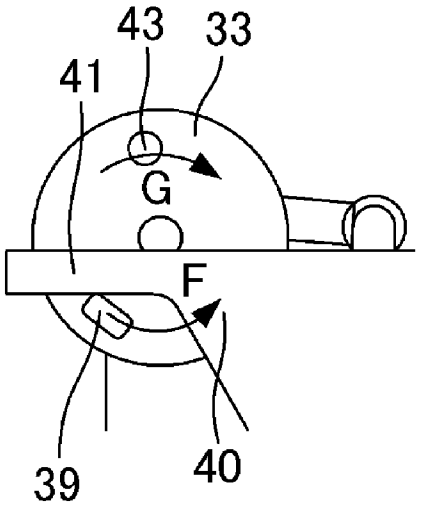
FIGS. 7A to 7C are diagrams depicting the open-close mechanism in a state where a shutter is rotating.
Figure 7B:
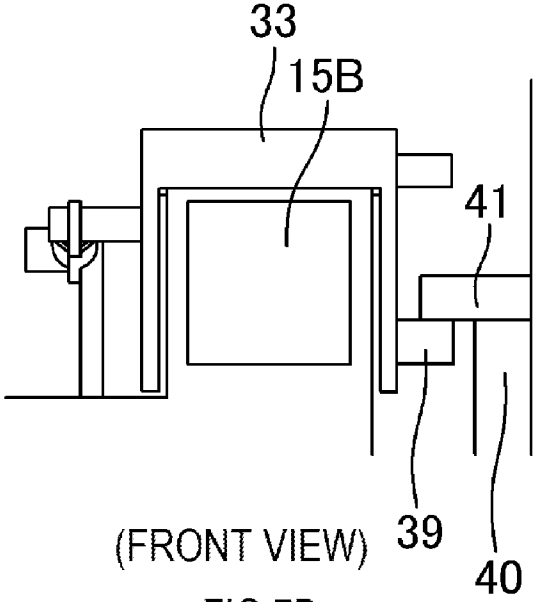
Figure 7A:
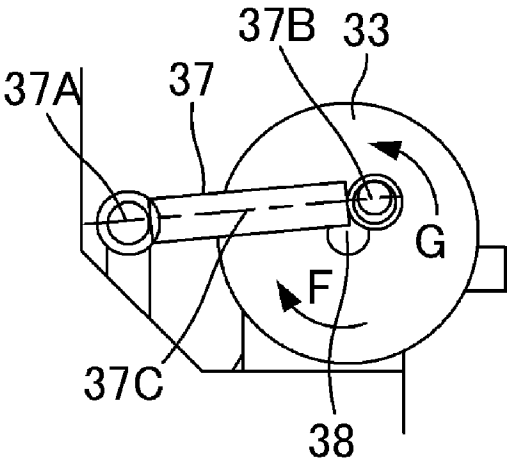
Figure 8C:
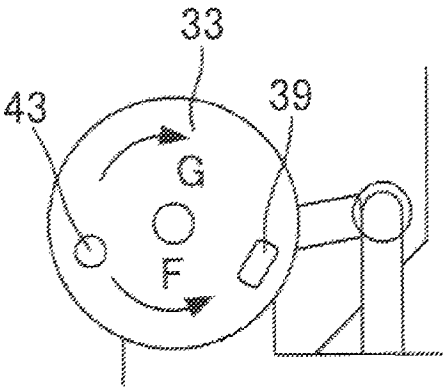
FIGS. 8A to 8C are diagrams depicting the open-close mechanism in a state where attaching of the storage container completes.
Figure 8B:
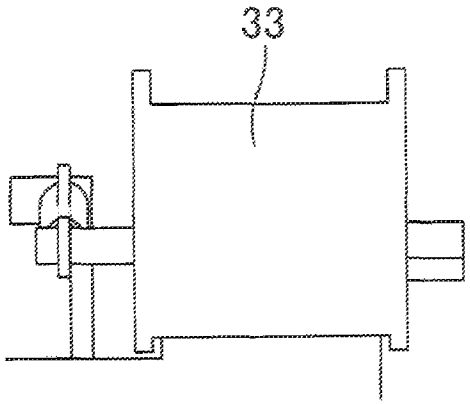
Figure 8A:
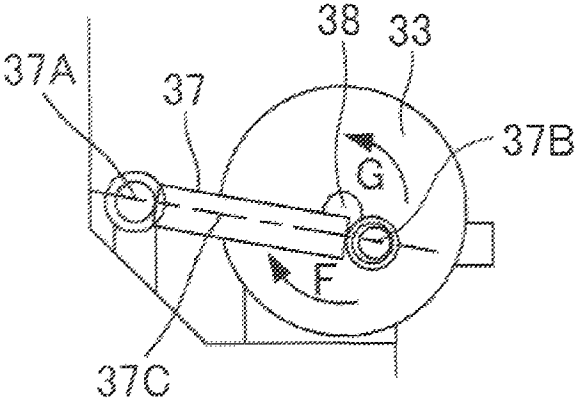

The mechanism of closing the shutter 33 in synchronization with operation of detaching the storage container 100 from the left door 30 will be described next with reference to FIGS. 5A to 8C. FIGS. 6A to 6C are diagrams depicting a state of the shutter 33 where the left door 30 is open. FIGS. 6A to 6C are enlarged perspective views of FIG. 5A. FIGS. 7A to 7C are diagrams depicting a state of the shutter 33 where detaching of the storage container 100 from the left door 30 begins. FIGS. 8A to 8C are diagrams depicting a state of the shutter 33 where the storage container 100 is completely removed from the left door 30. FIGS. 8A to 8C are enlarged perspective views of FIG. 5B.

In this example, the toner storage portion 15, the shutter 33 and the tension spring 37 constitute an biasing mechanism. One end of the tension spring 37 is fixed to a part of the toner storage portion 15, and the other end thereof is fixed to a part of the shutter 33. In this example, the tension spring 37 bias the toner storage portion 15 and the shutter 33 in such directions that a position where the tension spring 37 is attached in the shutter 33 and a position where the tension spring 37 is attached in the toner storage portion 15 are pulled toward each other. The tension spring 37 can change the state of the shutter 33 between the state of biasing the shutter 33 so that the shutter 33 moves from the open position to the close position, and the state of biasing the shutter 33 so that the shutter 33 moves from the close position to the open position. In this example, the state of biasing the shutter 33 can be switched by a boss 39 (first force receiving portion) and a boss 43 (second force receiving portion) receiving force from a shutter open-close rib 40 (force applying portion).

The boss 39 is a protruding portion disposed on the shutter 33, and is a portion that contacts a shutter closing surface 41 of the shutter open-close rub 40. The boss 39 can receive force for moving the shutter 33 from the position where the inlet 15B is opened to a position where the inlet 15A is closed. The boss 43 is a protruding portion disposed on the shutter 33, and is a portion that contacts a shutter opening surface 42 of the shutter open-close rib 40. The boss 43 can receive force for moving the shutter 33 from the close position to the open position when the storage container 100 is attached to the left door 30.

The shutter open-close rib 40 is a portion that contacts the boss 39 and the boss 43, and is integrated with the left door 30. When the storage container 100 is detached from the left door 30, the shutter open-close rib 40 can apply force to the boss 39 to move the shutter 33 from the open position to the close position. Further, when the storage container 100 is attached to the left door 30, the shutter open-close rib 40 can apply force to the boss 43 to move the shutter 33 from the close position to the open position.

First as shown in FIGS. 6A to 6C, in the state where the storage container 100 is attached to the left door 30, moment (moment force) is generated in the direction to open the shutter 33 (G direction). This moment is generated by the biasing force of the tension spring 37 centering around the rotation center 38 of the shutter 33. Although the moment in the G direction is generated in the shutter 33, rotation of the shutter 33 is limited to a predetermined position because of a rotation stopper (not illustrated) disposed on the toner storage portion 15. The rotation stopper is a part of the toner storage portion 15, and rotation of the shutter 33 is limited to within a predetermined range by a part of the shutter 33 contacting the rotation stopper. If an impact absorber, such as a sponge, is disposed on a portion where the shutter 33 contacts the rotation stopper, the impact sound that is generated when the shutter 33 contacts the rotation stopper can be reduced.

Then as shown in FIGS. 7A to 7C, in the state where detaching of the storage container 100 from the left door 30 begins, the storage container 100 is moved in the detaching direction, whereby the boss 39 contacts the shutter closing surface 41 of the shutter open-close rib 40. Then the shutter 33 starts to rotate in the direction to close the shutter 33 (F direction). If the storage container 100 is removed from the left door 30 in this state, the direction of the moment that acts on the shutter 33 is switched at a predetermined timing. In concrete terms, the direction of moment that acts on the shutter 33 changes from the G direction to the direction to close the shutter (F direction).

Here it is assumed that a position in the toner storage portion 15 where the tension spring 37 is installed is an installation position 37A, and a position in the shutter 33 where the tension spring 37 is installed is an installation position 37B. Then as shown in FIG. 8A (left side view), the direction of movement that acts on the shutter 33 changes when the virtual line 37C connecting the installation position 37A (one end) and the installation position 37B (other end) passes the rotation center axis line of the shutter 33.

If the direction of the moment is switched, the shutter 33 closes the inlet 15B, and the engagement of the boss 39 and the shutter closing surface 41 is released at this timing. Thereby in the state where the storage container 100 is completely removed from the left door 30, the moment is constantly active in the direction to close the shutter 33 (F direction) by the biasing force of the tension spring 37. In this way, the shutter 33 closes the inlet 15B in synchronization with operation of removing the storage container 100 from the left door 30.

<Mechanism of Opening Shutter>

Figure 9C:
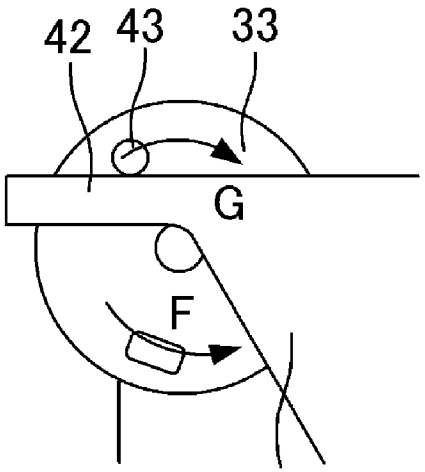
FIGS. 9A to 9C are diagrams depicting the open-close mechanism in a state where the shutter is rotating.
Figure 9B:
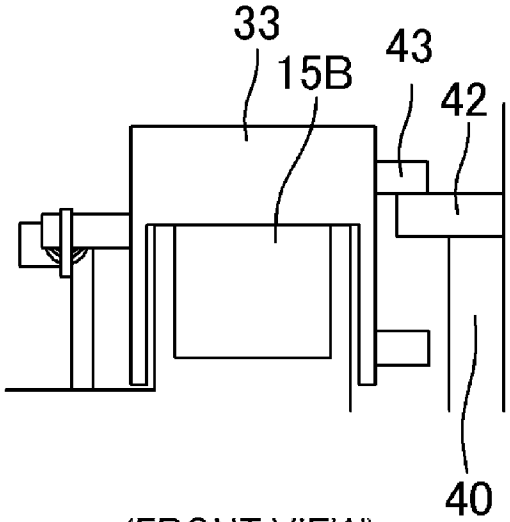
Figure 9A:
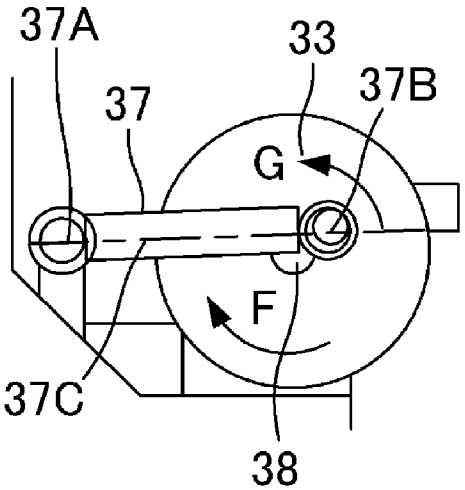

The mechanism of opening the shutter 33 in synchronization with operation of attaching the storage container 100 to the left door 30 will be described next with reference to FIGS. 8A to 8C and FIGS. 9A to 9C. FIGS. 9A to 9C are diagrams depicting a state where the shutter 33 opens in synchronization with operation of attaching the storage container 100 to the left door 30. First as shown in FIG. 8A (left side view), the shutter 33 is closing the inlet 15B in the state where the storage container 100 is detached from the left door 30.

The moment generated by the biasing force of the tension spring 37 is acting on the shutter 33 in the direction to close the shutter 33 (F direction). In this state, the rotation of the shutter 33 is limited to a predetermined position because of the rotation stopper (not illustrated) disposed on the toner storage portion 15. When the storage container 100 is being attached to the left door 30, the shutter 33 starts to rotate in the direction to open the shutter 33 (G direction) because the boss 43 contacts the shutter opening surface 42 on the shutter open-close rib 40.

If the storage container 100 is inserted further to the left door 30, the virtual line 37C connecting the installation position 37A and the installation position 37B moves above the rotation center axis line of the shutter 33, as shown in FIG. 9C (right side view). The direction of moment that acts on the shutter 33 is switched from the F direction to the G direction at this timing. By this change of moment, the shutter 33 opens the inlet 15B, and the engagement of the boss 43 and the shutter opening surface 42 is released at this timing. Thereby in the state where the storage container 100 is completely attached to the left door 30, the moment is constantly active in the direction to open the shutter 33 (G direction) by the biasing force of the tension spring 37. In this way, the shutter 33 opens the inlet 15B in synchronization with operation of attaching the storage container 100 to the left door 30.

<Structure to Guide the Toner Storage Container to Left Door>

Figure 10B:
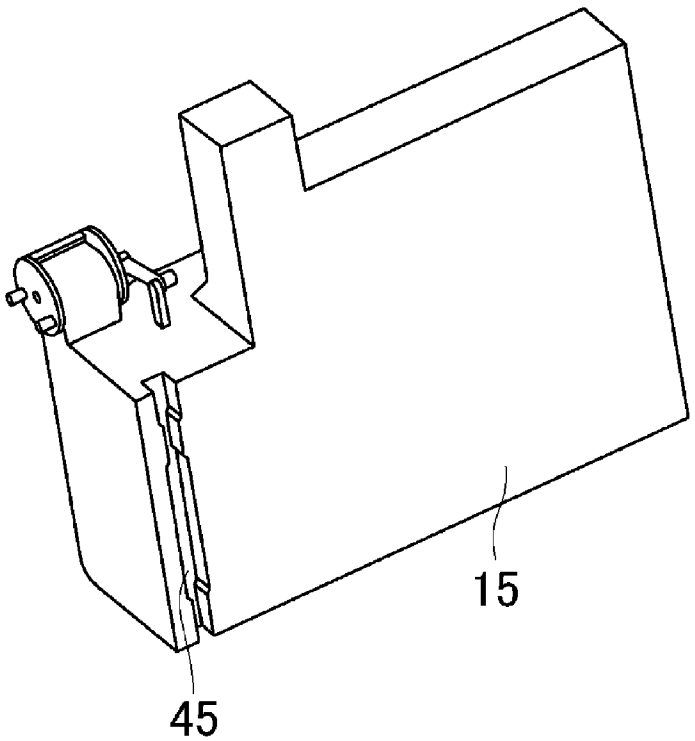
FIGS. 10A and 10B are external perspective views of the open-close door and the storage container.
Figure 10A:
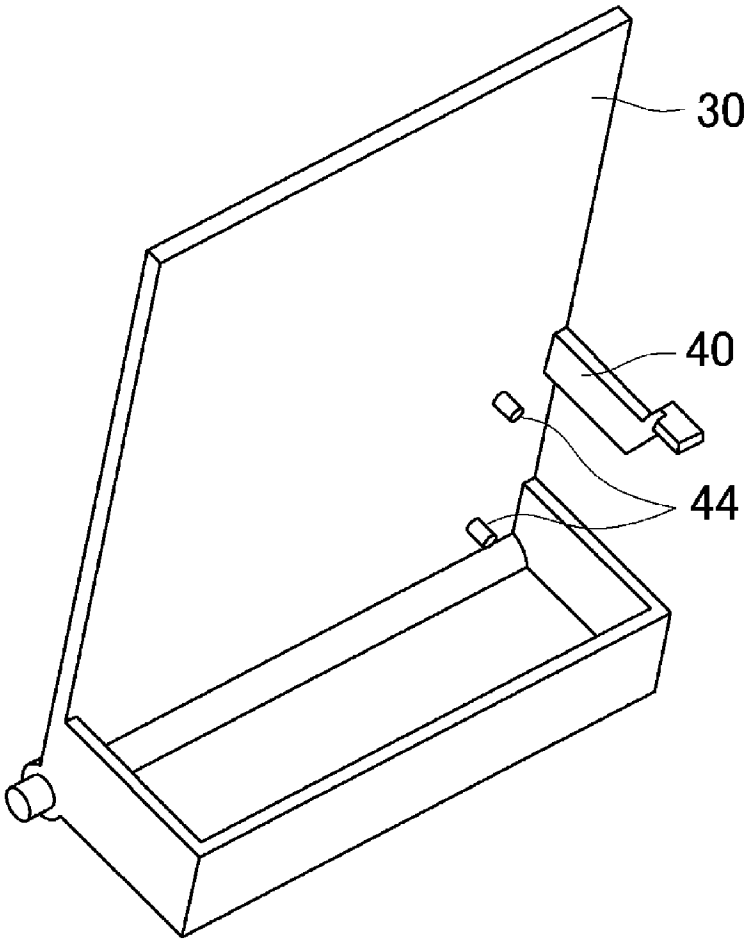
Figure 11C:
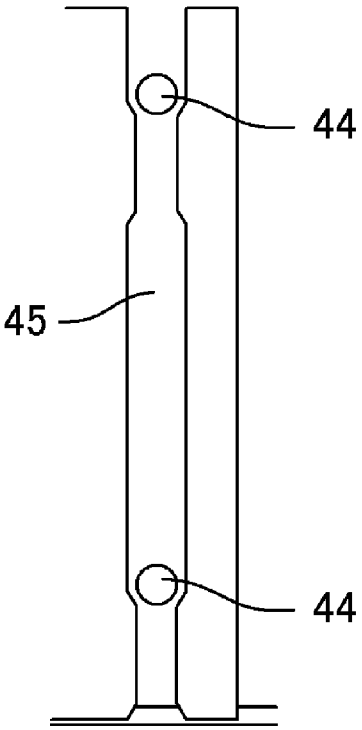
FIGS. 11A to 11C are diagrams depicting a state where a guided portion is guided by a guiding portion.
Figure 11B:
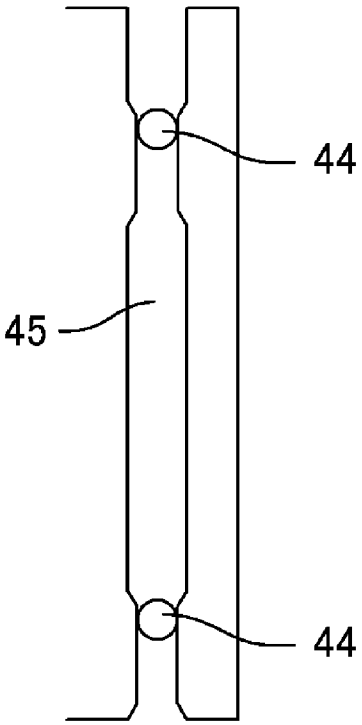
Figure 11A:
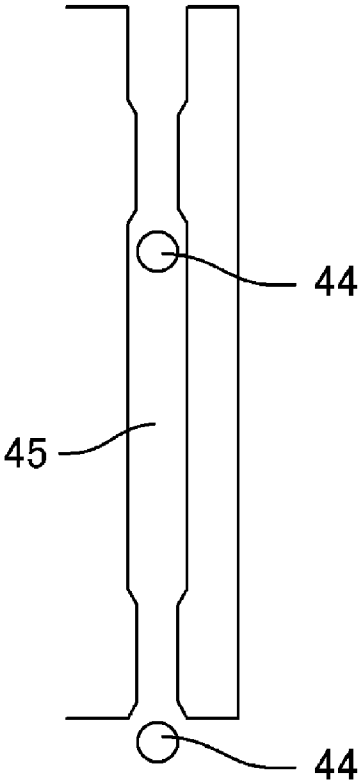

A structure to guide the storage container 100 to the left door 30 will be described with reference to FIGS. 10A, 10B and 11A to 11C. FIGS. 10A and 10B are perspective views of the left door 30 and the storage container 100. FIGS. 11A to 11C are diagrams depicting a state where insertion control bosses 44 (guided portion) disposed on the left door 30 are guided to an insertion control groove 45 (guiding portion) disposed on the toner storage portion 15. As shown in FIGS. 10A and 10B, two insertion control bosses 44 are disposed on the left door 30 on the side where the storage container 100 is attached. The insertion control groove 45, for guiding the insertion control bosses 44, is disposed on the toner storage portion 15.

To attach the storage container 100 to the left door 30, the insertion control bosses 44 disposed on the left door 30 are inserted into the insertion control groove 45 disposed on the storage container 100. FIG. 11A shows a state of the insertion control groove 45 where insertion of the storage container 100 into the left door 30 begins, and FIG. 11B shows a state of the insertion control groove 45 where the shutter 33 is rotating. FIG. 11C shows a state of the insertion control groove 45 where the storage container 100 is completely attached to the left door 30.

By guiding the insertion control bosses 44 using the insertion control grooves 45, the storage container 100 can be guided to the left door 30 such that the boss 39 and the boss 43 contact the shutter open-close rib 40. The insertion control groove 45 has guiding surfaces which extend in the direction where the toner storage portion 15 moves with respect to the left door 30. The guiding surfaces face each other so as to guide both sides of the insertion control boss 44 along the moving direction of the toner storage portion 15 with respect to the left door 30. The pair of guiding surfaces are constituted so that the facing distance decreases in a predetermined range before and after the direction of the moment that acts on the shutter 33 is switched by the tension spring 37. Thereby the boss 39 and the boss 43 can accurately contact the shutter open-close rib 40. In other words, an accurate positional relationship between the shutter 33 and the shutter open-close rib 40 can be guaranteed in the step of inserting the storage container 100 into the left door 30.

Figure 12A:
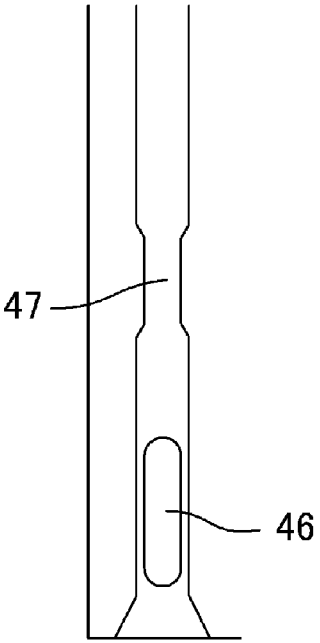
FIGS. 12A to 12C are diagrams depicting a state where the guided portion is guided by the guiding portion.
Figure 12B:
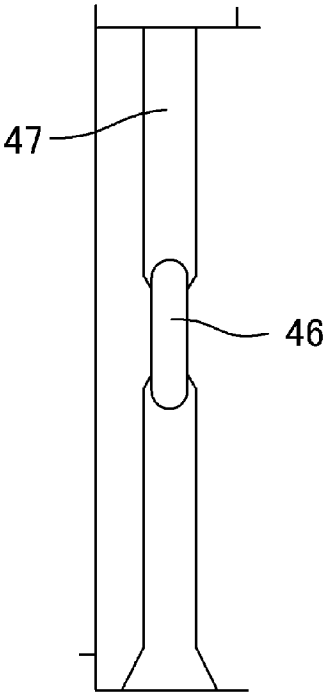
Figure 12C:
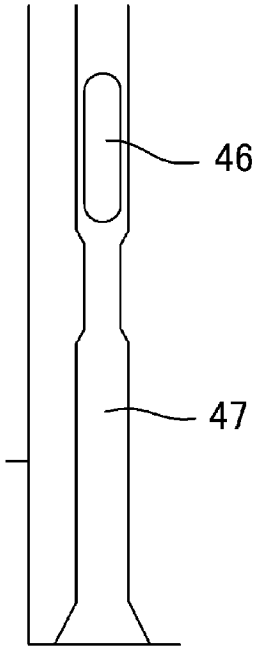

FIGS. 12A to 12C are diagrams depicting a state where the guiding control rib 46 is guided by the insertion control groove 47. FIG. 12A shows a state of the insertion control groove 47 where insertion of the storage container 100 into the left door 30 begins, and FIG. 12B shows a state of the insertion control groove 47 when the shutter 33 is rotating. FIG. 12C shows a state of the insertion control groove 47 when the storage container 100 is completely attached to the left door 30. In this example, the cylindrical insertion control bosses 44 are guided by the insertion control groove 45, but the shape of the portion guided by the guiding groove is not limited to this. For example, the portion guided by the guiding control groove 45 may be the insertion control rib 46 which extends in the guiding direction by the insertion control groove 45, as shown in FIGS. 12A to 12C. The shape of the insertion control groove 45 is not limited to the shape shown in FIGS. 11A to 11C either.

For example, the insertion control groove 47 may have the shapes shown in FIGS. 12A to 12C. The configurations of the insertion control bosses 44 and the insertion control groove 45 are not limited to specific configurations as long as the boss 39 and the boss 43 can accurately contact the shutter open-close rib 40. It is preferable that the insertion control bosses 44 are guided by the insertion control groove 45 at a position close to the shutter 33, since the accuracy of the positional relationship of the shutter 33 with respect to the shutter open-close rib 40 is guaranteed.

As described above, according to Example 1, the shutter disposed on the storage portion opens in synchronization with operation of attaching the storage container to the open-close door, and the shutter disposed on the storage position closes in synchronization with operation of detaching the storage container from the open-close door. In a conventional configuration, the shutter opens in synchronization with operation of closing the open-close door and the shutter closes in synchronization with operation of opening the open-close door. In the case of this configuration, however, a force to open or close the shutter is required in addition to a force to open or close the open-close door, hence the user is subject to a heavy load to open or close the open-close door. Therefore in this example, the shutter opens or closes in synchronization with operation of attaching or detaching the storage container, whereby the load applied to the user can be reduced.

Further, in Example 1, the first force receiving portion and the second force receiving portion receive force from the force applying portion, whereby the biasing state that is generated in the shutter by the biasing member is switched. Therefore the force for rotating the shutter at a timing of switching the biasing state of the shutter is not required. Also the user experiences a clicking sensation indicating a complete closure of the shutter.

Further, in Example 1, the guided portion disposed on the storage portion is guided by the guiding portion disposed in the open-close door, whereby the movement of the storage container with respect to the open-close door is guided when the storage container is attached to or detached from the open-close door. By the guided portion being guided to the guiding portion, the first force receiving portion and the second force receiving portion are accurately engaged with the force applying portion. Thereby the shutter can be accurately closed in synchronization with operation of removing the collection container. Further, in Example 1, the inlet and the outlet can be connected in synchronization with operation of closing the open-close door. This makes it unnecessary to independently perform the operation of connecting the inlet and the outlet and the operation of closing the open-close door, and improves the operation efficiency for the user.

Example 2

Figure 13:
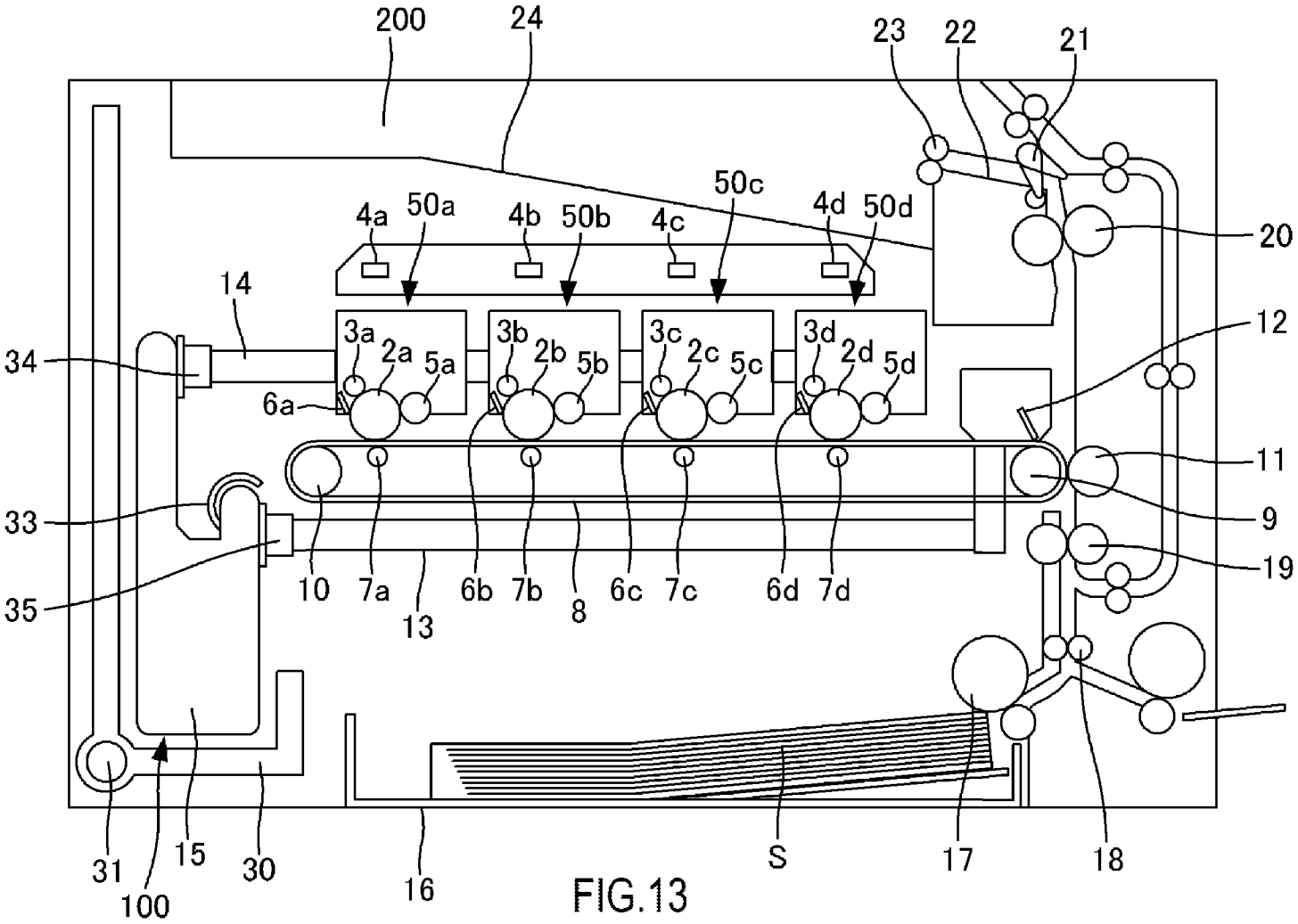
FIG. 13 is a schematic cross-sectional view of an image forming apparatus according to Example 2.
Figure 14:
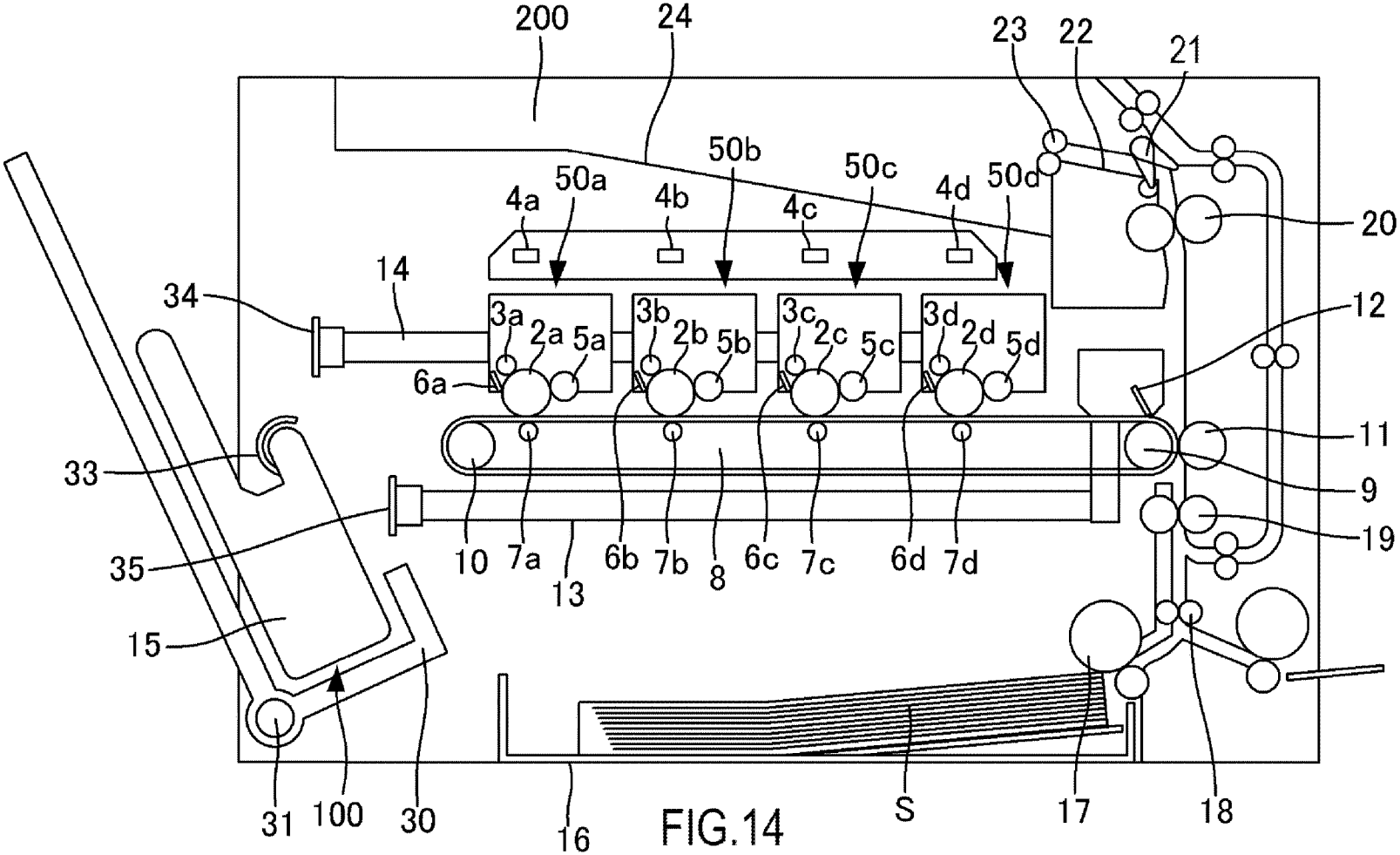
FIG. 14 is a schematic cross-sectional view of the image forming apparatus in a state where the open-close door is open.
Figure 15:
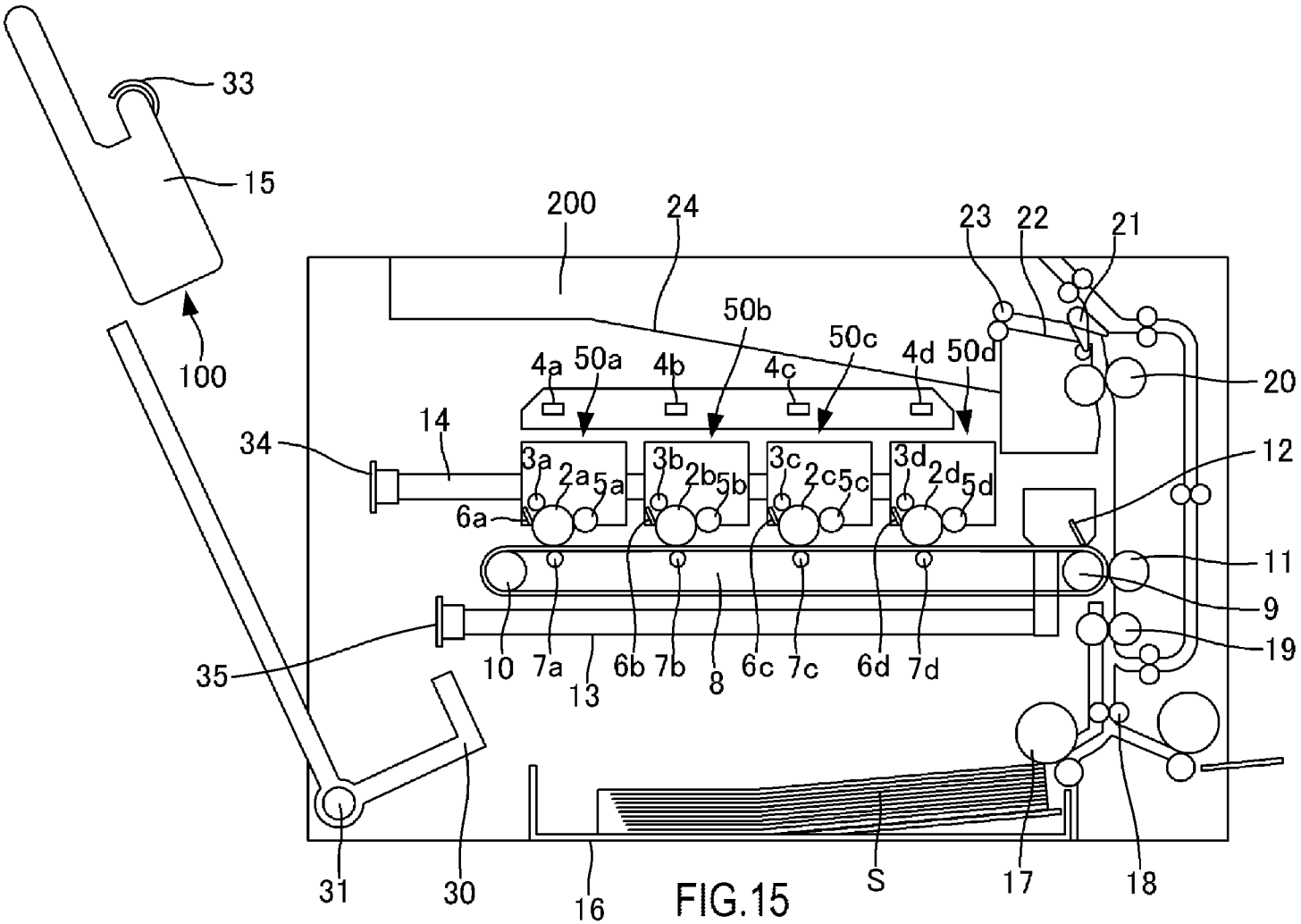
FIG. 15 is a cross-sectional view depicting a state where the storage container is detached from the open-close door.

Example 2 will be described next with reference to FIGS. 13 to 15. In Example 2, a portion having a same function as Example 1 is denoted with a same reference symbol, and description thereof is omitted. FIG. 13 is a schematic cross-sectional view of an image forming apparatus 200 according to Example 2. FIG. 14 is a schematic cross-sectional view of the image forming apparatus in a state where the left door 30 is open. FIG. 15 is a cross-sectional view showing a state where the toner storage portion 15 is removed from the left door 30. A difference between Example 2 and Example 1 is that in Example 2 the process cartridge 50 is disposed above the intermediate transfer belt 8. The rest is the same as Example 1.

Even if the process cartridge 50 is disposed above the intermediate transfer belt 8 as in the case of Example 2, the force required for opening or closing the open-close door can be reduced, just like Example 1.

In each example, the guiding portion is disposed on the storage portion, and the guided portion is disposed on the open-close door, but the present invention is not limited to this. The only requirement is that one of the guiding portion and the guided portion is disposed on the storage portion, and the other of the guiding portion and the guided portion is disposed on the open-close door. The configurations of the guiding portion and the guided portion are not limited as long as the storage container is guided with respect to the open-close door.

In each example, the open-close door is configured to open vertically with the rotation axis locating at the bottom, but the present invention is not limited to this. For example, the open-close door may open horizontally.

In each example, the attaching or detaching direction of the storage container is diagonally upward or diagonally downward, but the present invention is not limited to this. For example, the attaching or detaching direction of the storage container may be horizontal.

According to the present invention, the force required for opening or closing the cover disposed on the image forming apparatus can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110472, filed May 29, 2015, which is hereby incorporated by reference herein in its entirety.

What is claimed is:

1. A storage container that can be attached to or detached from an image forming apparatus including an apparatus main unit and an open-close member that can open or close with respect to the apparatus main unit, the storage container comprising:

a storage portion configured to store toner;

an opening portion configured to move the toner between the storage portion and the apparatus main unit; and a shutter configured to open or close the opening portion, wherein the storage container can be attached to the open-close member in an opened state with respect to the apparatus main unit, and wherein the shutter opens the opening portion in synchronization with operation of attaching the storage container to the open-close member, and closes the opening portion in synchronization with operation of detaching the storage container from the open-close member.

2. The storage container according to claim 1, wherein the shutter includes a force receiving portion configured to receive force, which is for moving the shutter from an open position, where the opening portion is opened, to a closed position, where the opening portion is closed, from a force applying portion disposed in the open-close member, when the storage container is detached from the open-close member.

3. The storage container according to claim 2, wherein the shutter includes a second force receiving portion configured to receive force, which is for moving the shutter from the closed position to the open position, from the force applying portion, when the storage container is attached to the open-close member.

4. The storage container according to claim 3, further comprising a biasing unit that can enter a first biasing state to bias the shutter so that the shutter moves from the open position to the closed position, and a second biasing state to bias the shutter so that the shutter moves from the closed position to the open position, wherein the biasing unit changes a state thereof from the second biasing state to the first biasing state when the first force receiving portion receives force from the force applying portion, and wherein the biasing unit changes a state thereof from the first biasing state to the second biasing state when the second force receiving portion receives force from the force applying portion.

5. The storage container according to claim 4, wherein the shutter is configured so that switching is implemented between a closed state, where the opening portion is closed, and an open state, where the opening portion is opened, by rotation of the shutter, wherein the biasing unit includes a biasing member, one end of which is fixed to the storage portion and the other end of which is fixed to the shutter at a position distant from a rotation center axis line of the shutter, and wherein switching is implemented between the first biasing state and the second biasing state when a virtual line, which connects one end and the other end of the biasing member, passes the rotation center axis line as a result of the rotation of the shutter.

6. The storage container according to claim 5, wherein until at least the biasing state of the biasing unit is switched over, the shutter is rotated by the force, which the first force receiving portion or the second force receiving portion receives from the force applying portion.

7. The storage container according to claim 4, wherein the shutter is configured so that switching is implemented between a closed state, where the opening portion is closed, and an open state, where the opening portion is opened, as a result of rotation of the shutter, and wherein the biasing unit has a biasing member, one end of which is fixed to the storage portion and the other end of which is fixed to the shutter at a position distant from the rotation center axis line of the shutter, so that moment force is generated in the shutter, and switching is implemented between the first biasing state and the second biasing state when an acting direction of the moment force is switched as a result of the rotation of the shutter.

8. The storage container according to claim 4, wherein the storage portion includes one of a guided portion that is guided to a guiding portion disposed in the open-close member, and a guiding portion that guides the guided portion disposed in the open-close member, and wherein movement of the storage container with respect to the open-close member, when the storage container is attached to or detached from the open-close member, is guided by the guided portion being guided to the guiding portion.

9. The storage container according to claim 8, wherein the guiding portion has a pair of guiding surfaces, which extend in the moving direction of the storage container with respect to the open-close member, and face each other so as to guide the guided portion from both sides thereof along the moving direction, and wherein the pair of guiding surfaces are configured such that the interval therebetween decreases within a predetermined range before and after the biasing state of the biasing mechanism is switched over.

10. The storage container according to claim 1, wherein the storage portion has a first inlet, which is the opening portion, a first shutter, which is the shutter, a second inlet, into which toner flows, and a second shutter for opening or closing the second inlet, and wherein the second shutter opens or closes the second inlet in synchronization with operation of opening or closing the open-close member.

11. The storage container according to claim 10, wherein a timing when the first shutter opens or closes the first inlet and a timing when the second shutter opens or closes the second inlet are different.

12. The storage container according to claim 10, wherein the first inlet is arranged closer to the apparatus main unit than the second inlet when the storage container is attached to the open-close member in the opened state.

13. The storage container according to claim 1, wherein waste toner in the image forming apparatus is transported to the storage container through the opening portion.

14. The storage container according to claim 12, wherein in a state where the shutter is open, the opening portion is connected with an outlet, which is disposed in the image forming apparatus and through which toner is discharged.

15. An image forming apparatus, comprising:

the storage container according to claim 1; and an open-close door which the storage container is attached to or detached from, wherein a timing when the storage container is attached to or detached from the open-close door and a timing when the open-close door is opened or closed are different.

16. A storage container that can be attached to or detached from an image forming apparatus including an apparatus main unit and an open-close member that can open or close with respect to the apparatus main unit, the storage container comprising:

a storage portion that has a first opening portion and a second opening portion for toner to enter, and stores the toner;

a first shutter that is disposed in the storage portion and opens the first opening portion in synchronization with operation of attaching the storage container to the open-close member; and a second shutter that is disposed in the storage portion, opens the second opening portion in synchronization with operation of closing the open-close member when the open-close member is closed after the first opening portion is opened by the first shutter, and closes the second opening portion in synchronization with the operation of opening the open-close member.

17. The storage container according to claim 15, wherein a timing when the first shutter opens or closes the first inlet and a timing when the second shutter opens or closes the second inlet are different.

18. The storage container according to claim 16, wherein the first opening portion is arranged closer to the apparatus main unit than the second opening portion when the storage container is attached to the open-close member in an opened state with respect to the apparatus main body.

19. A storage container that can be attached to or detached from an image forming apparatus including an apparatus main unit and an open-close member that can open or close with respect to the apparatus main unit, the storage container comprising:

a storage portion configured to store toner;

an opening portion configured to move the toner between the storage portion and the apparatus main unit; and a shutter configured to open or close the opening portion, wherein the storage container can be attached to the open-close member in an opened state with respect to the apparatus main unit, and wherein the shutter opens the opening portion in synchronization with operation of attaching the storage container to the open-close member.

20. The storage container according to claim 19, wherein the storage portion has a first inlet, which is the opening portion, a first shutter, which is the shutter, a second inlet, into which toner flows, and a second shutter for opening the second inlet, wherein the second shutter opens the second inlet in synchronization with operation of opening the open-close member, and wherein the first inlet is arranged closer to the apparatus main unit than the second inlet when the storage container is attached to the open-close member in the opened state.

* * * * *